US005997380A

United States Patent [19]

Yang

[11] Patent Number: 5,997,380

[45] Date of Patent: Dec. 7, 1999

[54] LIQUID SAC TYPE BRASSIERES HAVING WATER WAVE FINGER PRESSING MASSAGING FUNCTIONS

[76] Inventor: Li-Fan Yang, 9th Fl., 47-4, Te Hsing W. Rd., Taipei, Taiwan

[21] Appl. No.: 09/139,433

[22] Filed: Aug. 25, 1998

[51] Int. Cl.[6] ..... A41C 3/10

[52] U.S. Cl. ..... 450/57; 450/30; 623/7

[58] Field of Search ..... 450/1, 30, 31, 450/37, 38, 39, 54, 55, 56, 57, 92, 93; 623/7, 8; 601/14

[56] References Cited

U.S. PATENT DOCUMENTS 4,125,117 11/1978 Lee ..... 450/57
5,480,429 1/1996 Weber-Unger ..... 450/57
5,522,892 6/1996 Lin ..... 450/57
5,782,671 7/1998 Suen et al. ..... 450/57

*Primary Examiner*—Gloria M. Hale
*Attorney, Agent, or Firm*—Rosenberg, Klein & Lee

[57] ABSTRACT

An improvement on liquid sac type brassieres including brassieres having a left cup and a right cup each of which has a sac disposed therein. The sac is comprised of two tough water-impermeable soft plastic sheets fused together to form a bag-like container for receiving a required volume of liquid. The surface of the soft plastic sheet on the inner side of the sac is provided with a plurality of finger-like soft massaging bosses. The wavy motion of the liquid inside the sacs cause the soft massaging bosses to press and massage the acupuncture points around the user's breasts to stimulate breast blood circulation and metabolism.

6 Claims, 9 Drawing Sheets

LIQUID SAC TYPE BRASSIERES HAVING WATER WAVE FINGER PRESSING MASSAGING FUNCTIONS

BACKGROUND OF THE INVENTION (a) Field of the Invention

The present invention relates to an improved liquid sac type brassieres, and more particularly to new brassieres that have infrared and water wave pressing massaging functions.

(b) Description of the Prior Art

Women are usually concerned with the size of their busts. Busts can be enlarged by means of surgery or medicine; however, they have adverse side effects.

For safety reasons, brassieres padded with sponge or silicon are commonly used to women to make their busts appear larger, but they do not look natural. In recent years, there has been developed a kind of brassieres that utilizes liquid sacs to create the look of large busts. As shown in FIGS. 1 and 2, cups 1 of brassieres B are each provided with a sac 2 filled with a liquid 21 such that the sac 2 is just located at a lower portion of the user's breast A to support the breast A and prevent drooping thereof. Besides, the liquid will move with the movement of the user, so that there is a natural appearance. Therefore, although they are expensive, they are very popular. Prior art includes R.O.C. Publication No. 214038 for brassieres with stimulating massaging functions, and R.O.C. Publication No. 301866 for improved brassier pad structure.

Said R.O.C. Publication No. 214038 is characterized in that the interior of a container is filled with two liquids of different densities that do not dissolve in each other. The liquids will shake with the movement of the user's body to stimulate and massage the user's breasts in a natural fashion. However, the concept of utilizing the vibration of two liquids of different densities to stimulate and massage the breasts is good, massaging function in actual use is not ideal.

As for R.O.C. Publication No. 301866, it is characterized in that a container is filled with a plurality of hollow ball particles and liquid lubricant. The hollow ball particles are used to massage the breasts. However, as the hollow ball particles are disposed in the liquid, the intended effects cannot be achieved, as with said R.O.C. Publication No. 214038.

SUMMARY OF THE INVENTION

A primary object of the present invention is to provide liquid sac type brassieres having water wave finger pressing massaging effects, in which the surface of an inner edge of a sac of each cup of the brassieres is provided with a plurality of finger-like soft massaging bosses and the wavy motion of the liquid inside the sac causes the massaging bosses to press and massage the acupuncture points around the breasts like using fingers to thereby stimulate breast blood circulation and metabolism.

Another object of the present invention is to provide an improvement on liquid sac type brassieres, in which the soft massaging bosses have infrared electromagnetic mineral powder added thereto during molding so as to smoothen blood circulation during massaging by the massaging bosses.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
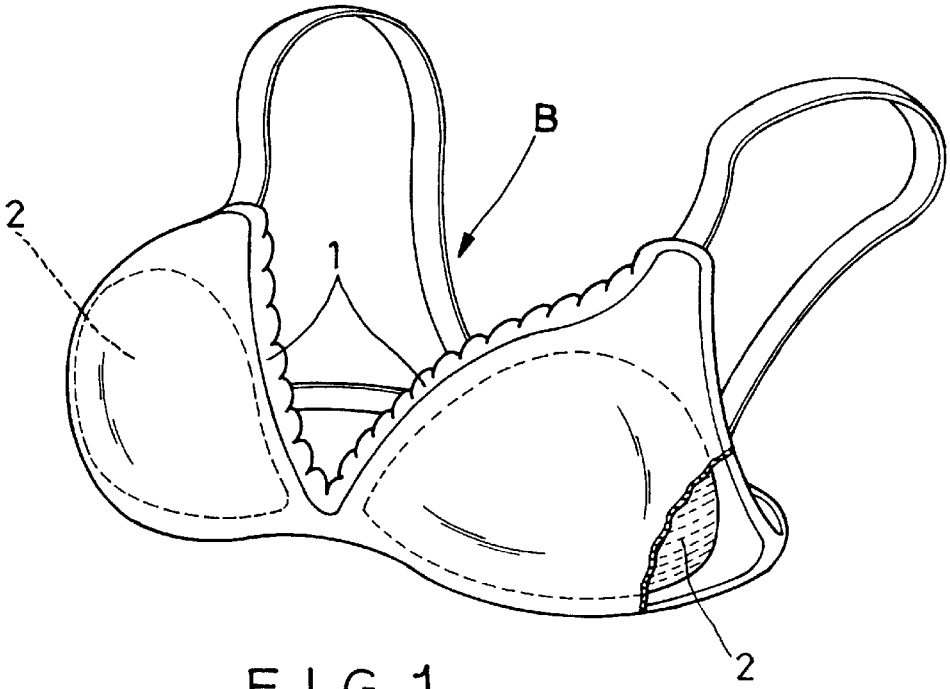
FIG. 1 (PRIOR ART)
FIG. 1 is a schematic view of conventional liquid sac type brassieres of the prior art.
Figure 2:
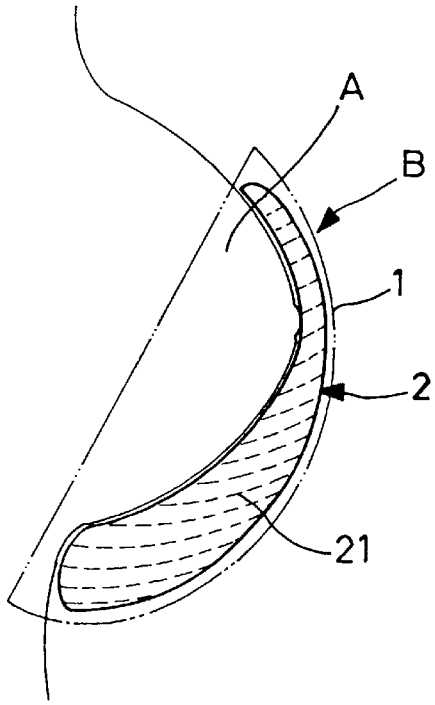
FIG. 2 (PRIOR ART)
FIG. 2 is a schematic view illustrating the use state of the liquid sac type brassieres of the prior art.
Figure 3:
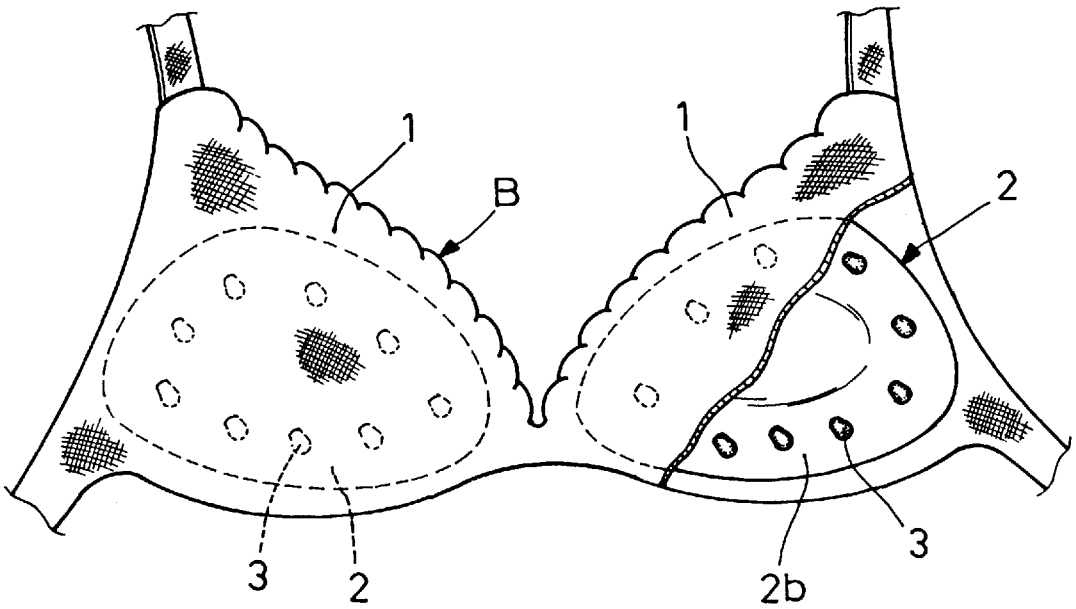
FIG. 3 is a schematic view of the first preferred embodiment of the present invention, showing the inner sides of brassieres B.
Figure 4:
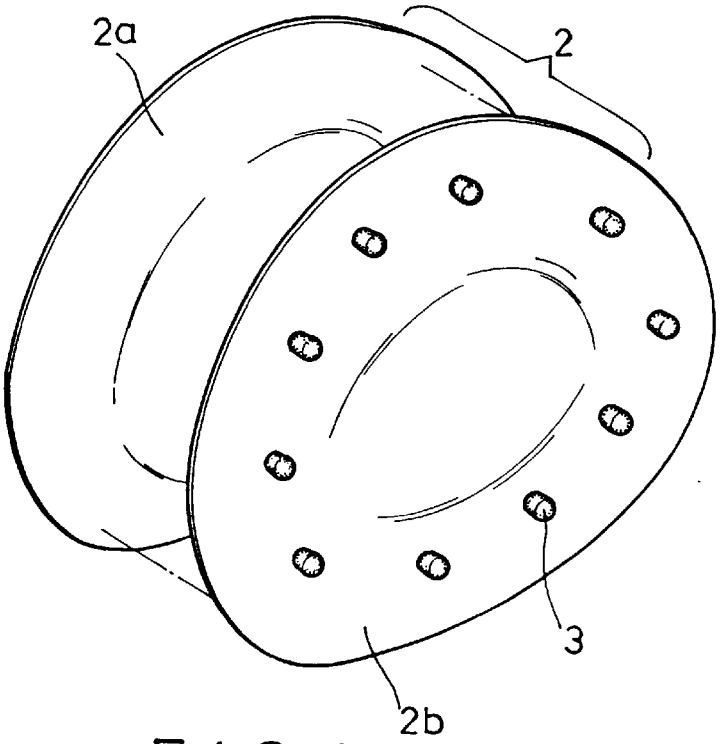
FIG. 4 is a perspective exploded view of the main structure of the first preferred embodiment.

With reference to FIGS. 3 and 4, the liquid sac type brassieres having water wave finger pressing massaging functions according to the present invention comprises brassieres B having left and right two cups 1 each having a sac 2 disposed in the interior thereof. The sac 2 includes two tough and water-impermeable soft plastic materials 2*a*, 2*b* fused together to form a bag-like container for receiving a required volume of liquid 21. The sac 2 is preferably formed by using silicon films, polyester films or other equivalent materials so that it is tough and water-impermeable. Furthermore, the liquid is preferably a white wax oil or silicon oil so that the wavy motion appears realistic and natural.

The present invention is characterized in that the soft plastic material 2*b* on the inner sac of each sac 2 is provided with a plurality of finger-like soft massaging bosses 3. By means of the wavy effect generated as a result of the motion of the liquid 21 inside the sac 2, the soft massaging bosses 3 can press and massage the acupuncture points around the user's breast to stimulate blood circulation around the breast and enhance metabolism.

Figure 5:
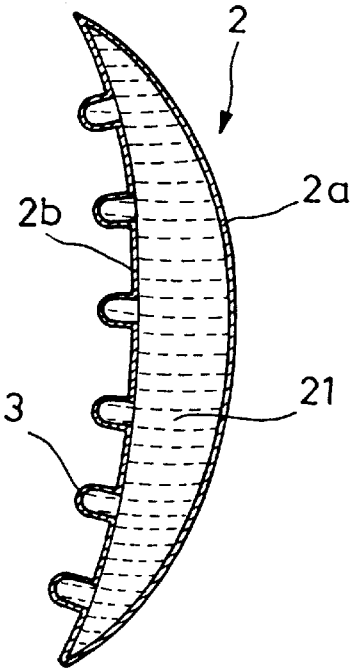
FIG. 5 is a side view of the first preferred embodiment.
Figure 6:
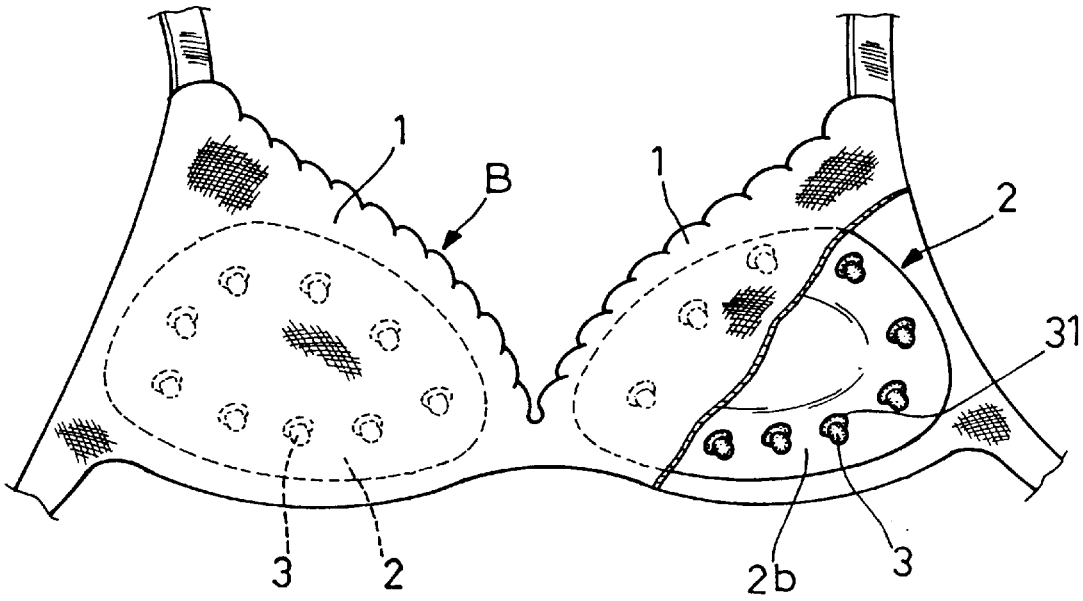
FIG. 6 is a schematic view of the second preferred embodiment of the present invention.
Figure 7:
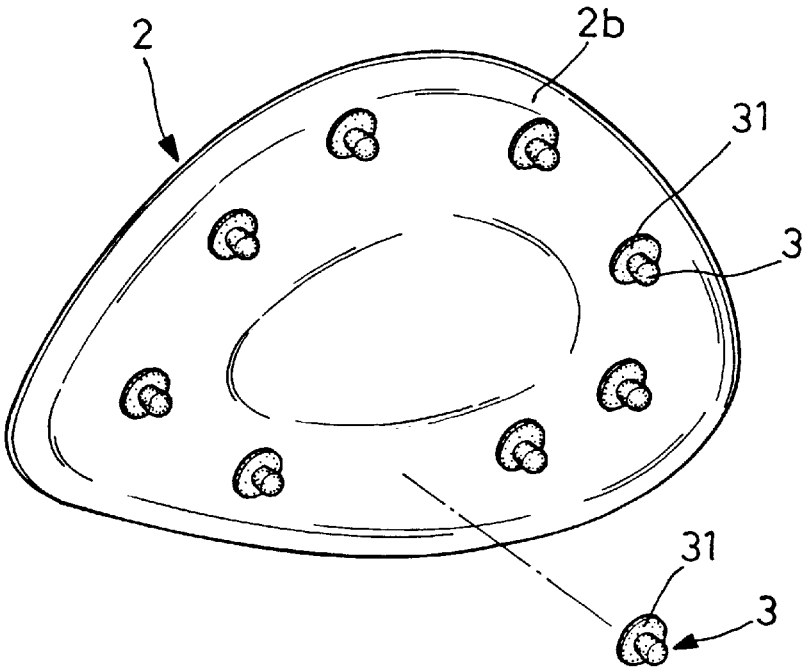
FIG. 7 is a perspective view of the main structure of the second preferred embodiment.
Figure 8:
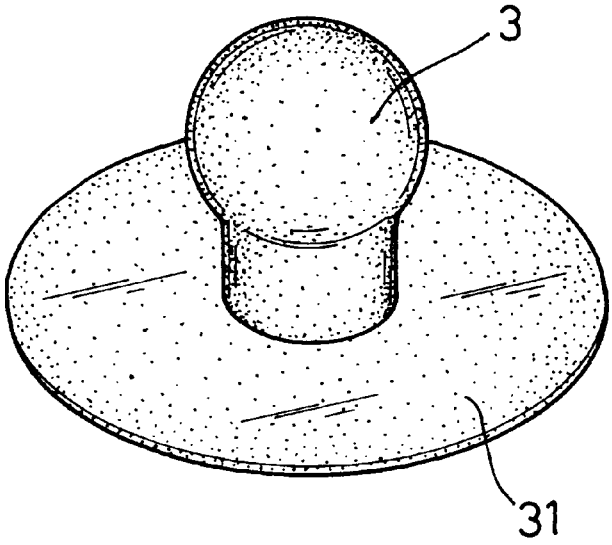
FIG. 8 is a perspective view of a massaging boss of the second preferred embodiment.
Figure 9:
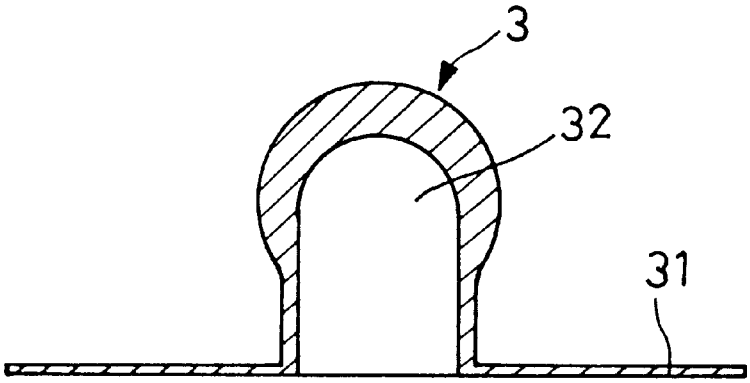
FIG. 9 is a sectional view of the massaging boss of the second preferred embodiment.

FIGS. 3 and 5 show a preferred embodiment of the arrangement of the massaging bosses 3. Before the soft plastic material 2*b* on the inner side fuses with the soft plastic material 2*a* on the outer side of the sac 2 using high frequencies, the soft massaging bosses 3 are integrally formed by extrusion.

Another embodiment of the massaging bosses 3 is shown in FIGS. 6 to 9. A plurality of massaging bosses 3 having enlarged fusing surfaces 31 at a bottom edge are fused on the surface of the soft plastic material 2*b* on the inner side of the sac 2 using high frequencies.

Certainly, the massaging bosses 3 may be solid ones (not shown) or hollow bodies 32.

Furthermore, when forming the massaging bosses 3, mineral powder having infrared electromagnetic characteristics can be added.

Figure 10:
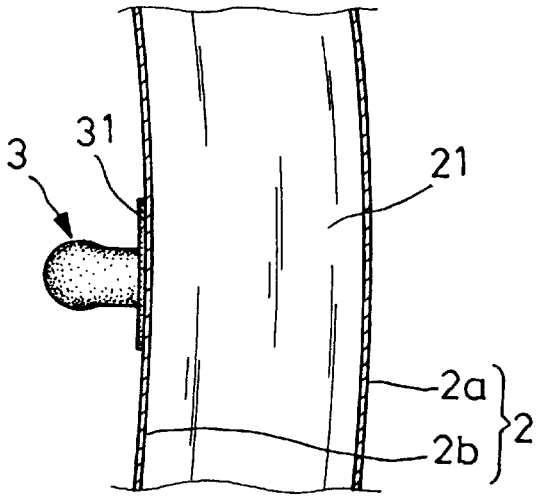
FIG. 10 is a schematic view illustrating fusion of the massaging boss with the sac according to the second preferred embodiment.
Figure 11:
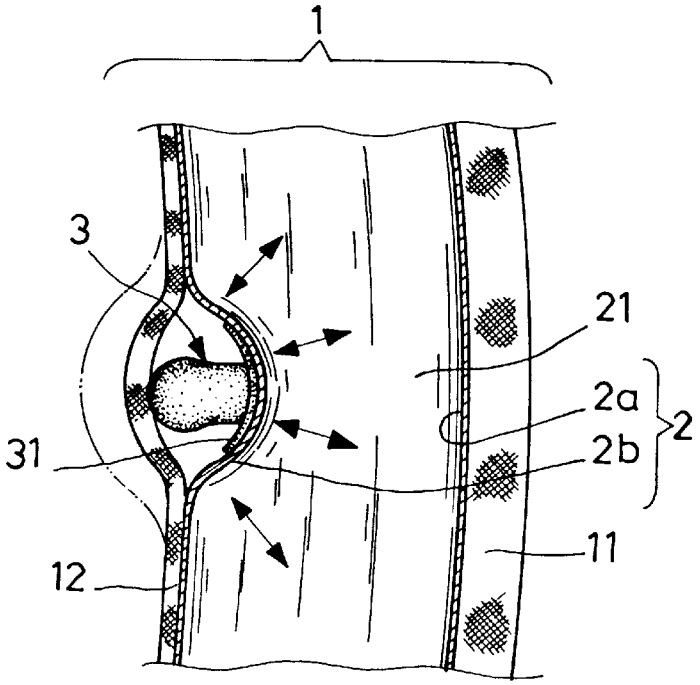
FIG. 11 is a fragmentary schematic view illustrating installation of the sac in the cup of the brassieres.
Figure 12:
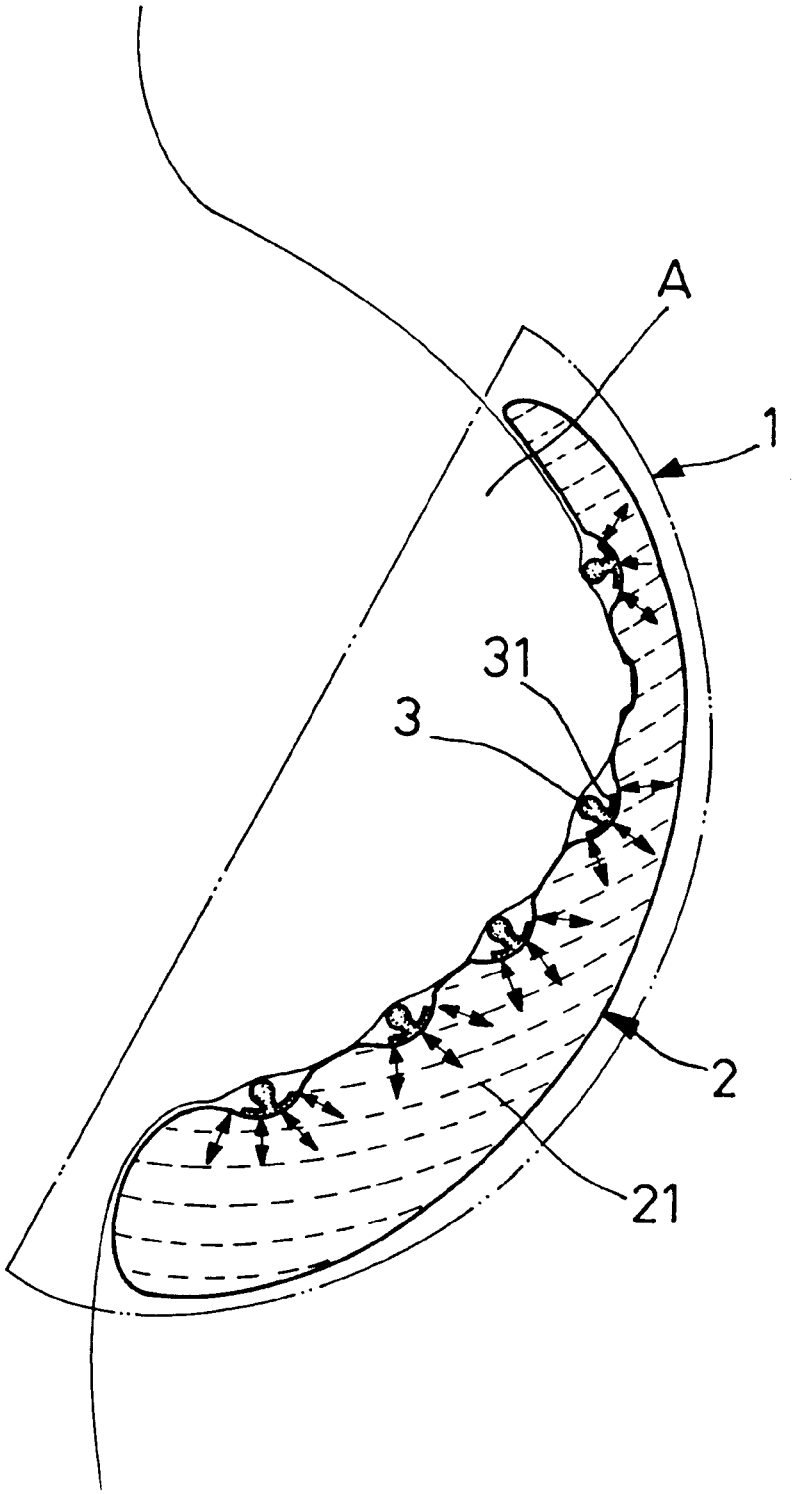
FIG. 12 illustrates the use state of the second preferred embodiment.

In addition, as shown in FIG. 10, after the massaging bosses 3 are secured on the sac 2, the sac 2 is placed in between an outer layer cotton cloth 11 and an inner layer cotton cloth 12 of each cup 1 such that the massaging bosses 3 are inside the inner layer cotton cloth 12 of the cup 1 and are coupled to the cup 1 integrally, as shown in FIG. 11. Since the sac 2 is formed to match the profile of the cup 1, and the inner layer cotton cloth 12 will force the massaging bosses 3 to retract or shrink slightly towards the sac 2. Therefore, when the user wears the brassieres of the present invention, they will look as natural as ordinary brassieres. Referring to FIG. 12, when the user walks or does exercise, the liquid 21 filling the interior of the sac 2 will shake. By means of the physical characteristic of the water wave effect, the soft massaging bosses 3 will press and massage the acupuncture points around the breasts A like using fingers to stimulate breast blood circulation to keep the breasts fit. Furthermore, the infrared electromagnetic effect will smoothen blood circulation to enhance metabolism to strengthen breast tissues.

Figure 13:
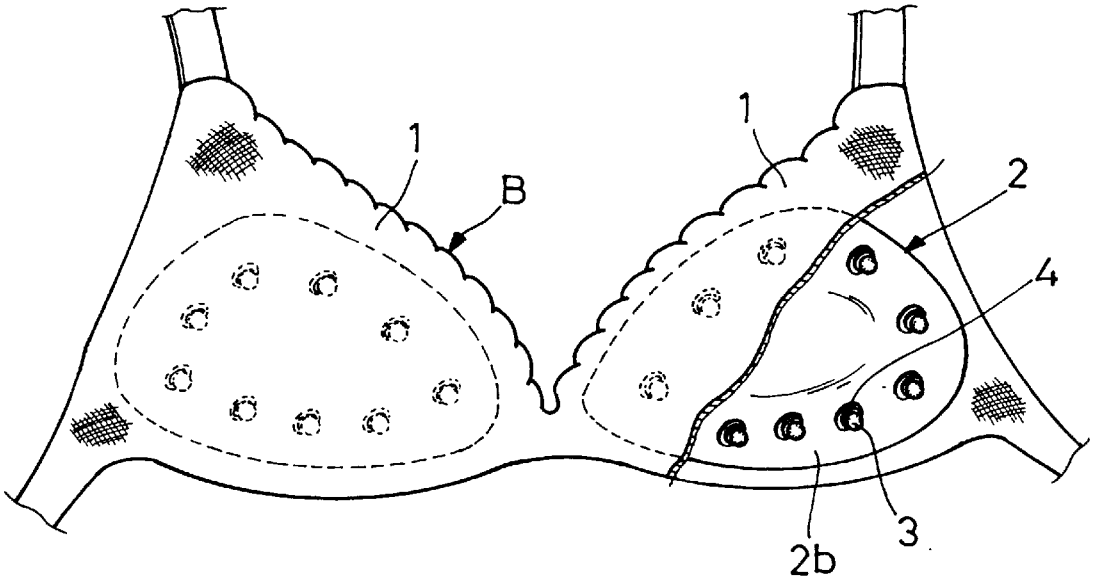
FIG. 13 is a schematic view of the third preferred embodiment of the present invention.
Figure 14:
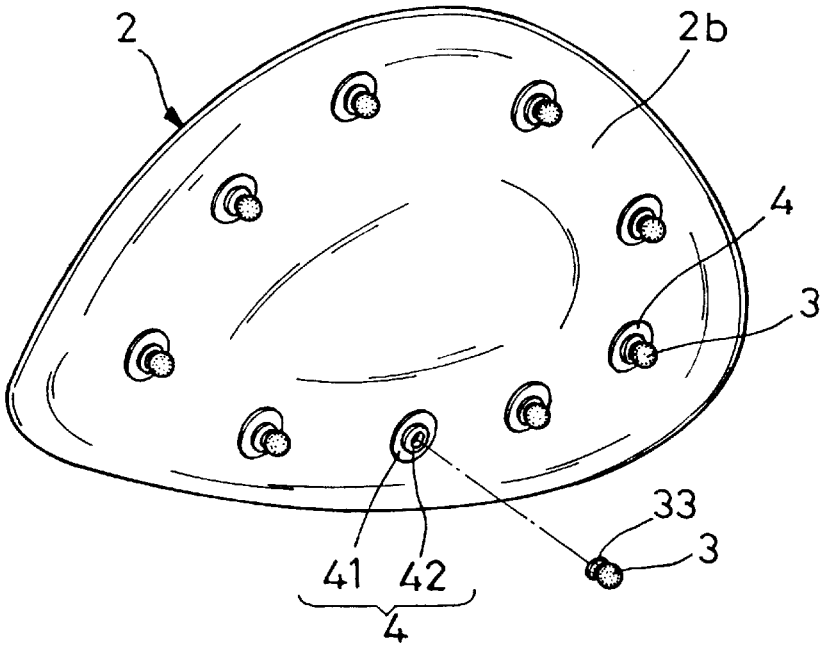
FIG. 14 is a perspective view of the main structure of the third preferred embodiment.
Figure 15:
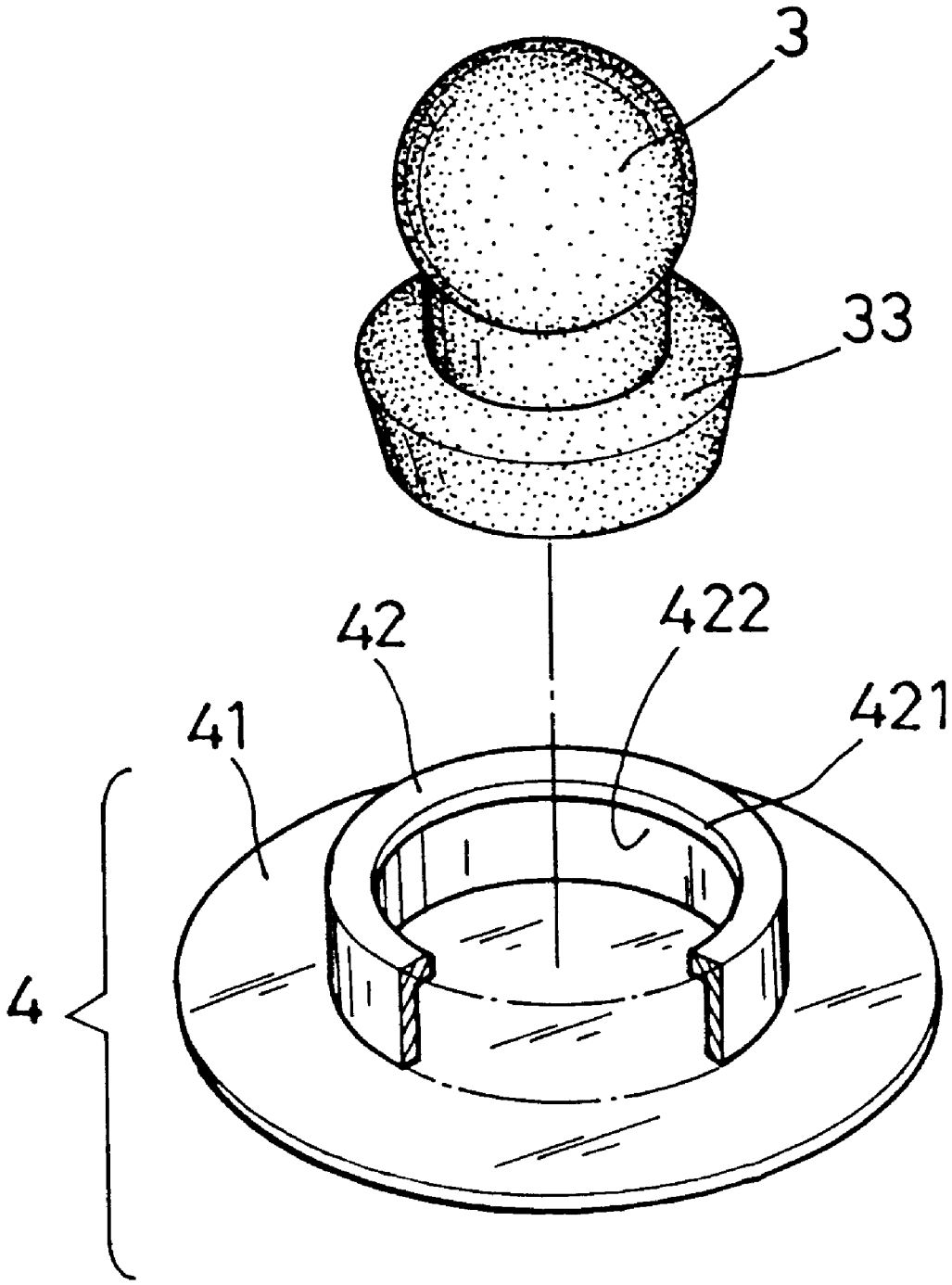
FIG. 15 is a perspective exploded view of the positioning structure of the massaging boss of the third preferred embodiment.

FIGS. 13 to 15 show another preferred embodiment of the massaging bosses 3. As shown, a plurality of positioning elements 4 are fused to the surface of the plastic materials 2*b* on the inner side of the sac 2 using high frequencies. As shown in FIG. 15, the positioning elements 4 each including a bottom fusing face 41 and a positioning element having an upper opening 421 and a hollow portion 22 of a diameter larger than that of the upper opening 421. The positioning element 42 receives and positions a massaging boss 3 having a bottom retaining flange 33 inserted therein. In this embodiment, the reason why the massaging bosses 3 are configured to be inserts is that the number and size of the massaging bosses 3 can vary according to actual requirements to different various needs.

In summary, it can be appreciated that the massaging bosses 3 disclosed in the present invention can be provided on the surface of the soft plastic material on the inner side of the sac in various ways to achieve the intended water wave finger pressing massaging effects.

Although the present invention has been illustrated and described with reference to the preferred embodiment thereof, it should be understood that it is in no way limited to the details of such embodiment but is capable of numerous modifications within the scope of the appended claims.

What is claimed is:

1. A liquid sac brassiere for massaging a user's breast comprising:

(a) a sac containing a volume of liquid, said sac including a first and a second sheet of flexible plastic fused each to the other to form a chamber containing a liquid composition, said first sheet of flexible plastic being positioned contiguous an inner surface of a brassiere, said second sheet of flexible plastic being positioned contiguous said user's breast; and, (b) a plurality of massaging bosses coupled to said second sheet of flexible plastic and extending therefrom for contact with said user's breast, said massaging bosses being flexible for deformation when contacting said user's breast.

2. The liquid sac brassiere as recited in claim 1 where said massaging bosses are fixedly coupled to said second sheet of flexible plastic.

3. The liquid sac brassiere as recited in claim 2 where said massaging bosses are fused to said second sheet of flexible plastic in one piece formation.

4. The liquid sac brassiere as recited in claim 3 where at least one of said massaging bosses includes a boss interior chamber in open fluid communication with said liquid composition within said chamber of said sac.

5. The liquid sac brassiere as recited in claim 1 where at least one of said massaging bosses are removably coupled to said sheet of flexible plastic.

6. The liquid sac brassiere as recited in claim 5 including a plurality of positioning elements fixedly secured to said second sheet of flexible plastic, said positioning elements having a recess portion formed thereon for insert of a respective massaging boss.

* * * * *